US006488439B1

(12) United States Patent
Lackey, Sr.

(10) Patent No.: US 6,488,439 B1
(45) Date of Patent: Dec. 3, 2002

(54) DOWNROD ADAPTOR

(75) Inventor: Robert W. Lackey, Sr., Hickory, NC (US)

(73) Assignee: Prime Home Impressions, LLC, Coppell, TX (US)

( * ) Notice: Subject to any disclaimer, the term of this patent is extended or adjusted under 35 U.S.C. 154(b) by 29 days.

(21) Appl. No.: 09/649,252

(22) Filed: Aug. 28, 2000

(51) Int. Cl.[7] ..... B65G 33/32
(52) U.S. Cl. ..... 403/305; 403/362; 403/378
(58) Field of Search ..... 403/3, 4, 305, 403/300, 299, 362, 378

(56) References Cited

U.S. PATENT DOCUMENTS 5,090,654 A * 2/1992 Ridings et al. ..... 403/90 X
5,349,513 A * 9/1994 Taylor, III ..... 416/5 X
5,454,692 A * 10/1995 Davis ..... 416/5
5,613,832 A * 3/1997 Su ..... 416/244 R
5,797,422 A * 8/1998 Tokarz ..... 403/3 X
6,139,279 A * 10/2000 Pearce et al. ..... 416/244 R
6,158,964 A * 12/2000 Gajewski ..... 416/244 R
6,171,060 B1 * 1/2001 Gajewski ..... 416/244 R
6,234,757 B1 * 5/2001 Pearce ..... 416/244 R

* cited by examiner

*Primary Examiner*—Lynne H. Browne
*Assistant Examiner*—John Cottingham
(74) *Attorney, Agent, or Firm*—J. Herbert O'Toole; Nexsen Pruet Jacobs & Pollard, LLC

(57) ABSTRACT

An adaptor for a ceiling fan downrod which uses a pair of concentric cylinders with a larger cylinder capable of receiving a large downrod component and a smaller cylinder capable of receiving a smaller downrod component.

2 Claims, 3 Drawing Sheets

DOWNROD ADAPTOR

BACKGROUND OF THE INVENTION

The present invention relates generally to fan assemblies, and more particularly an adaptor for a ceiling fan support.

Numerous types of fan assemblies presently exists. For instance, there are currently on the market downrods having a ½ inch diameter and a ¾ diameter. While these are nominal references, the actual outer dimensions are ¾" for a ½" diameter downrod and 1" for a ¾" downrod. In recent history, the larger diameter assembly has become more popular. An alternate technique for handling this problem is disclosed in our pending U.S. application Ser. No. 09/083,715 filed May 22, 1998.

The trend towards the larger fan assembly presents a quandary to the retailer. Currently, the retailer must stock both sizes of fan assembly components. Stocking the less popular smaller fan assembly components consumes valuable shelf space. The shelf space could be more effectively utilized with other products for stocking a larger amount of the more popular larger size fan assembly components. Inventory costs and sales volumes are potentially affected.

Clearly there is room for improvement in the art.

SUMMARY OF THE INVENTION

It is therefore an object of the present invention to allow for the use of common parts on non-standardized products.

It is a further object of the present invention to provide an adaptor for attaching a downrod between a ceiling fan and a ceiling fan support to provide for different sized downrods.

It is a further object of the present invention to provide an adaptor that allows the use of a downrod on a ceiling fan assembly that would not otherwise be capable of use with the ceiling fan assembly.

It is a further object of the present invention to decrease the amount of shelf required to display parts if different sizes.

These, as well other objects, are accomplished by an adaptor which can convert form large to small, or small to large, downrod formed of a pair of adjoining cylinders with a larger cylinder having an inside diameter capable of receiving a large downrod component and a second cylinder concentric with the first cylinder having an outer diameter substantially the same as a smaller downrod component. Each cylinder has a diametric hole therethrough for receipt of a locking pin, while the larger cylinder has threaded holes for receipt of locking screws.

DETAILED DESCRIPTION OF THE INVENTION

In accordance with this invention it has been found that a central downrod adaptor may be used to permit placement of downrods of varying diameters with fan assemblies. While this adaptor is described in terms of adapting a larger downrod where a smaller downrod would normally be required. It will become apparent upon reading of this description that the adaptor may be utilized to go in the direction of replacing a larger downrod with a smaller downrod, should that be desired. Various other advantages and features will become apparent from reading the following description with reference to various figures of drawing.

Figure 1:
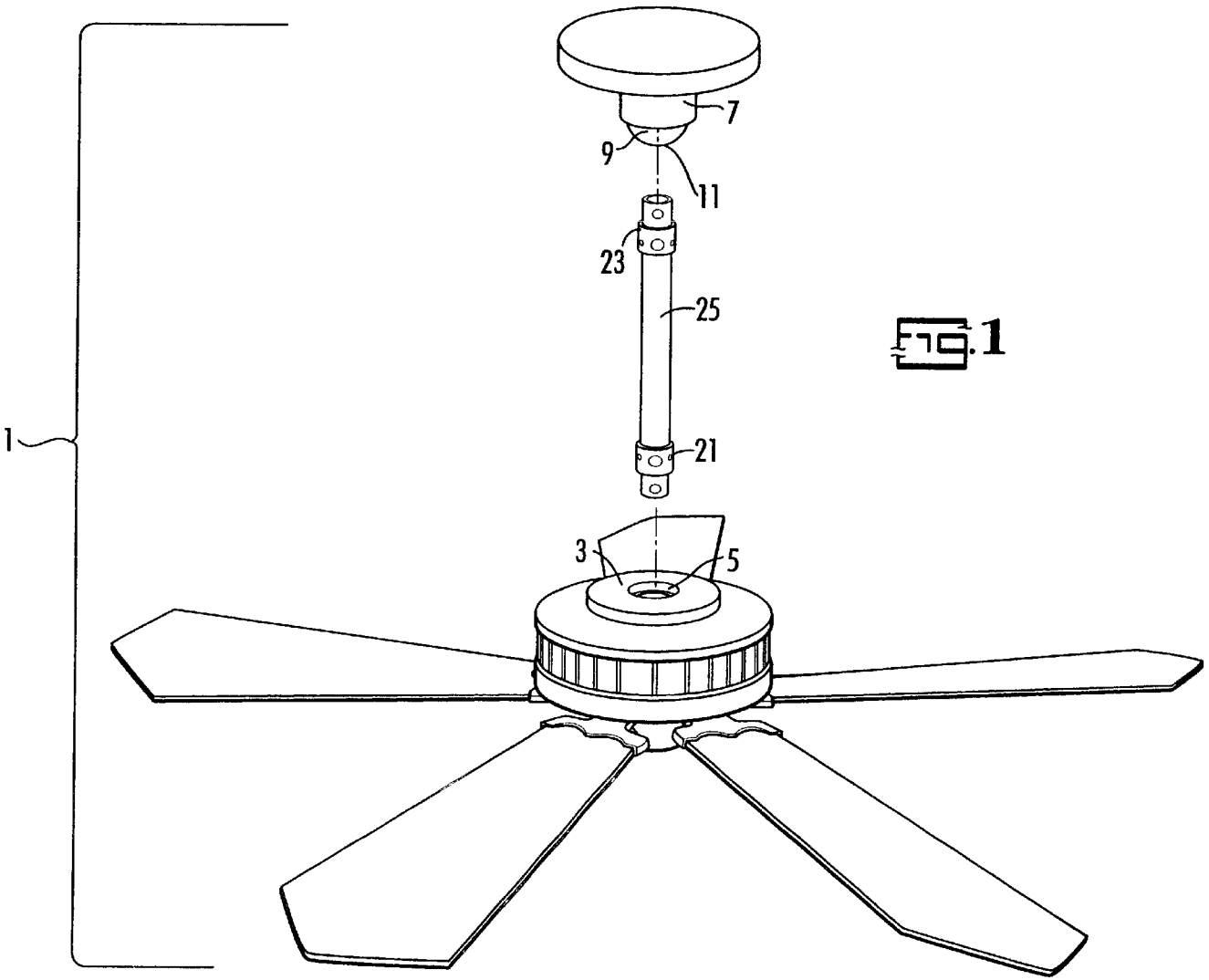
FIG. 1 of the drawings illustrates a ceiling fan assembly in assembly view.

FIG. 1 illustrates a fan assembly 1 having a fan motor 3 having an opening 5 therein for a receipt of a smaller diameter downrod. Additionally, a ceiling mounting fixture 7 having a ball mounting 9 therein for a receipt of a small diameter downrod at opening 11. Adaptors 21 and 23 are the adaptors of this invention permitting a large size downrod 25 to be coupled thereto to permit receipt within the smaller size openings 11 and 5.

Figure 2:
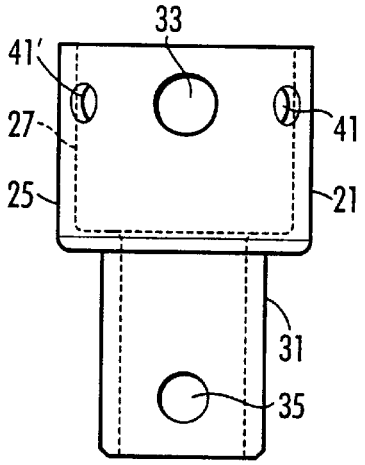
FIG. 2 of the drawings is an adaptor according to this invention.

FIG. 2 of the drawings illustrates the adaptor in the position of the adaptor identified as 21 in FIG. 1. Adaptor 21 has a large cylinder 25 with an inside diameter on surface 27 substantially conforming to the diameter of a larger size downrod but sufficiently large to permit insertion therein.

Figure 3:
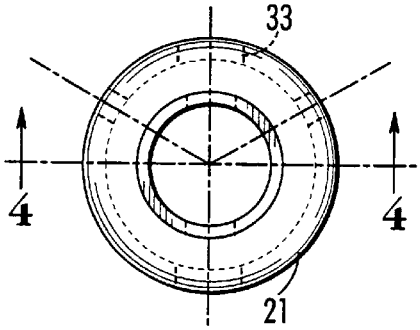
FIG. 3 of the drawings is a top view of FIG. 2.
Figure 4:
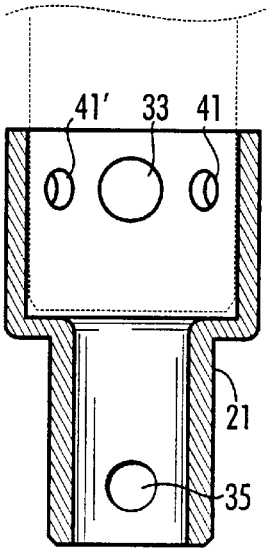
FIG. 4 of the drawings is a cross-section view along the line 3, 3 of FIG. 2.

A second cylinder 31 is concentric with the first cylinder 21 and has an outer diameter substantially the same as a smaller diameter downrod to permit placement within openings 11 and 5 of FIG. 1. Both cylinders 21 and 31 had diametrically opposed holes 33 and 35, best seen in FIGS. 3 and 4.

Figure 5:
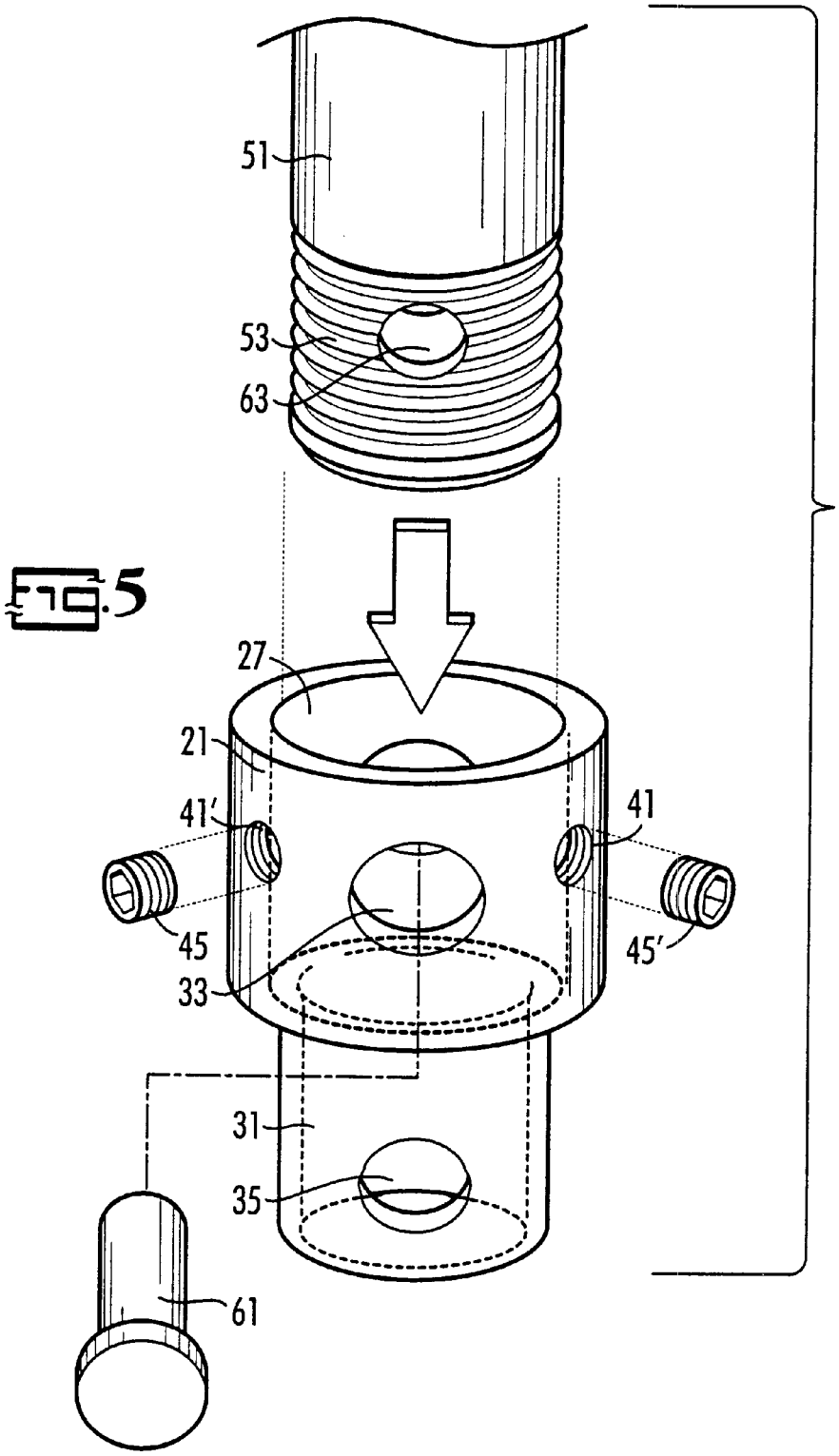
FIG. 5 of the drawings is an assembly view of an adaptor in association with a large downrod of this invention.

Larger diameter cylinder 21 has a pair of threaded holes 41 and 41' for placement of lock screws 45 and 45' (FIG. 5).

FIG. 5 of the drawings is an assembly view in phantom, illustrating a larger diameter downrod 51 for a receipt of the inner wall 27 of large cylinder 21. It should be noted that threads 53 are illustrated on downrod 51 since such downrods are normally sullied with threads, however the assemblies have made no use of such threads in recent history utilizing pins and locking screws for appropriate attachment. It is seen that downrod 51 is placed within the inner diameter 27 of cylinder 21 where a locking pin 61 passes through a mating hole 63 and also through diametric holes 33 of cylinder 21 to lock downrod 51 in place. Lockscrews 45 and 45' respectively pass through threaded holes 41 and 41' to lock downrod 51 even more securely in place. In a like manner, diametric hole 35 of smaller cylinder 31 is locked into place when connected to either motor 3 or ball mount 9.

It is thus seen that the invention described herein provides an adaptor which presents much versatility with regard to ceiling fan fixtures. It additionally provides for reduced use of multiple components on retail shelves, thus freeing such shelf space for more diverse items. As many variations will become apparent to those with skill in the art from a reading of the above description which is exemplary in nature, such variations are included within the spirit and scope of this invention as defined by the following appended claims.

What is claimed is:

1. An adaptor for a ceiling fan downrod to permit replacement of a downrod of one diameter with a downrod of a larger diameter, comprising:

a first cylinder having an inside diameter and an outside diameter, said inside diameter substantially conforming to said outside diameter but being sufficiently larger than said downrod of a larger diameter to permit insertion of said downrod of a larger diameter through an opening thereof;

a second cylinder concentric with said first cylinder, said second cylinder having an outside diameter substantially the same as said one diameter, said second cylinder positioned adjacent said first cylinder on an end opposite said opening;

a first pair of diametric holes through said first cylinder for receipt of a pin therethrough to lock said larger diameter downrod in place when inserted;

a second pair of diametric holes through said second cylinder to permit insertion thereof of a locking pin therethrough;

said first cylinder defining a pair of threaded holes therethrough for placement of locking screws.

2. The adaptor of claim 1 wherein said threaded holes are not diametric.

* * * * *